US007510402B2

(12) United States Patent
Ma et al.

(10) Patent No.: US 7,510,402 B2
(45) Date of Patent: Mar. 31, 2009

(54) ELECTRICAL CONNECTOR

(75) Inventors: Hao-Yun Ma, Tu-Cheng (TW); Hsiu-Yuan Hsu, Tu-Cheng (TW); Shih-Wei Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/724,532

(22) Filed: Mar. 14, 2007

(65) Prior Publication Data

US 2007/0218738 A1 Sep. 20, 2007

(30) Foreign Application Priority Data

Mar. 14, 2006 (CN) ..... 2006 2 0070308

(51) Int. Cl.
*H01R 12/00* (2006.01)

(52) U.S. Cl. ..... 439/71; 439/66

(58) Field of Classification Search ..... 439/71, 439/66, 70

See application file for complete search history.

(56) References Cited

U.S. PATENT DOCUMENTS 5,713,744 A * 2/1998 Laub ..... 439/71
6,164,980 A * 12/2000 Goodwin ..... 439/70
6,644,981 B2 * 11/2003 Choy ..... 439/70
6,755,668 B2 * 6/2004 Copper et al. ..... 439/83
6,786,738 B2 * 9/2004 Lin ..... 439/71
7,179,126 B2 * 2/2007 Chen ..... 439/607
2004/0077202 A1 * 4/2004 Copper et al. ..... 439/241
2006/0094265 A1 * 5/2006 Zheng ..... 439/69

* cited by examiner

*Primary Examiner*—Michael C. Zarroli
*Assistant Examiner*—Vladimir Imas
(74) *Attorney, Agent, or Firm*—Wei Te Chung

(57) ABSTRACT

Provided is an electrical connector for electrically connecting a plug assembly having a plurality conductive pads to a PCB, comprising a dielectric housing including a base having a plurality of sidewalls extending therefrom; the base defining a receiving cavity for receiving the plug assembly together with said sidewalls; a plurality of spring contacts received in the base, and defining a resilient arm extending above the base, the resilient arm having a contact portion for wiping the corresponding conductive pads of the plug assembly and exerting a tangential component force, while the plug assembly is mated into the receiving cavity of the housing; wherein the base is divided into several sections, each section having a plurality of spring contacts received therein, the spring contacts received in a same section oriented in a same direction but different from those in other sections, sidewalls which is opposite to the composition of the tangential component force defining a plurality of push finger in order to exert resilient force to cancel or substantially cancel or reduce the composition of the tangential component force.

2 Claims, 5 Drawing Sheets

ELECTRICAL CONNECTOR

BACKGROUND OF THE INVENTION

1. Field of the Invention

The present invention relates generally to an electrical connector, and more particularly relates to an electrical connector having a plurality of contacts arranged in several different directions.

2. Background of the Invention

Various electronic systems, such as computer, comprise a wide array of components mounted on printed circuit boards, such as daughterboards and motherboards, which are interconnected to transfer signals and power throughout the system. The transfer of signals and power between the circuit boards requires electrical interconnection between the circuit boards. Certain interconnections include a socket assembly, e.g. a LGA socket and a plug assembly, e.g. a CPU module. Some socket assemblies include spring contacts, which are configured to mate with conductive pads on the plug assembly. As the socket assembly and plug mate, the spring contacts exert a normal force on the contact pads, thus ensuring proper electrical contact between the spring contacts and the conductive pads.

In order to establish adequate contact, the spring contact wipe across the conductive pads, cleaning both surfaces, as the plug assembly is mated into the socket assembly. Typically, during mating, the spring contacts are deflected. During deflection, the spring contacts exert a resistive force on the plug assembly. The resistive force typically has normal and tangential components. The normal force is usually caused by the frictional behavior of the wiping motion.

As electronic systems become more sophisticated, the systems require an increasing number of spring contacts and equally increasing number of conductive pads. Thus, as electronic systems become more advanced, the quantity of spring contacts with the socket assemblies increase. Conventional socket assemblies align the conductive pads in a desired pattern and orient the spring contacts in the same direction. For example, if one thousand spring contacts are included within a socket assembly all one thousand contacts are similarly oriented. Each spring contact includes a wiping portion that extends toward a common side of the socket assembly. As mentioned above, as the plug assembly is mated into the socket assembly, the spring contacts exert a tangential component force on the plug assembly (a component force of the total force, as discussed above). Because all of the spring contacts are oriented in a same direction, the individual tangential forces exerted by the spring contact add together. The sum of the tangential force may be great enough to cause the plug assembly to shift tangentially while being mated. When the plug assembly shifts, the spring contacts may lose contact with the conductive pads. Even if the spring contacts do not lose the complete contact with the conductive pads, the spring contacts may only partially contact the conductive pads which diminishes the reliability of the electrical connection between the conductive pads and the spring contacts.

In view of the foregoing, a new and improved electrical connector is desired to solve above-mentioned problems.

SUMMARY OF THE INVENTION

Accordingly, an object of the present invention is to provide an electrical connector that maintains adequate contact between spring contacts and conductive pads. Additionally, another object of the present invention is to provide an electrical connector that ensures the spring contacts remaining adequately aligned to conductive pads.

To achieve the above-mentioned objects, certain embodiments of the present invention provide an electrical connector. The electrical connector comprises a dielectric housing including a base having a plurality of sidewalls extending therefrom; the base defining a receiving cavity for receiving the plug assembly together with said sidewalls; a plurality of spring contacts received in the base, and defining a resilient arm extending above the base, the resilient arm having a contact portion for wiping the corresponding conductive pads of the plug assembly and exerting a tangential component force, while the plug assembly is mated into the receiving cavity of the housing; wherein the base is divided into several sections, each section having a plurality of spring contacts received therein, the spring contacts received in a same section oriented in a same direction but different from those in other sections, sidewalls which is opposite to the composition of the tangential component force defining a plurality of push finger in order to exert resilient force to cancel or substantially cancel or reduce the composition of the tangential component force.

As mentioned above, while the plug assembly is mated into the receiving cavity of the housing, the composition of the tangential force exerted by the spring contacts, is reduced or cancelled or substantially cancelled by the resilient force exerted by the push fingers. Thus, the electrical connector maintains adequate contact between the spring contacts and the corresponding pads of the plug assembly and ensures the spring contacts remaining adequately aligned to conductive pads of the plug assembly .

DETAILED DESCRIPTION OF THE PREFERRED EMBODIMENT OF THE INVENTION

Figure 1:
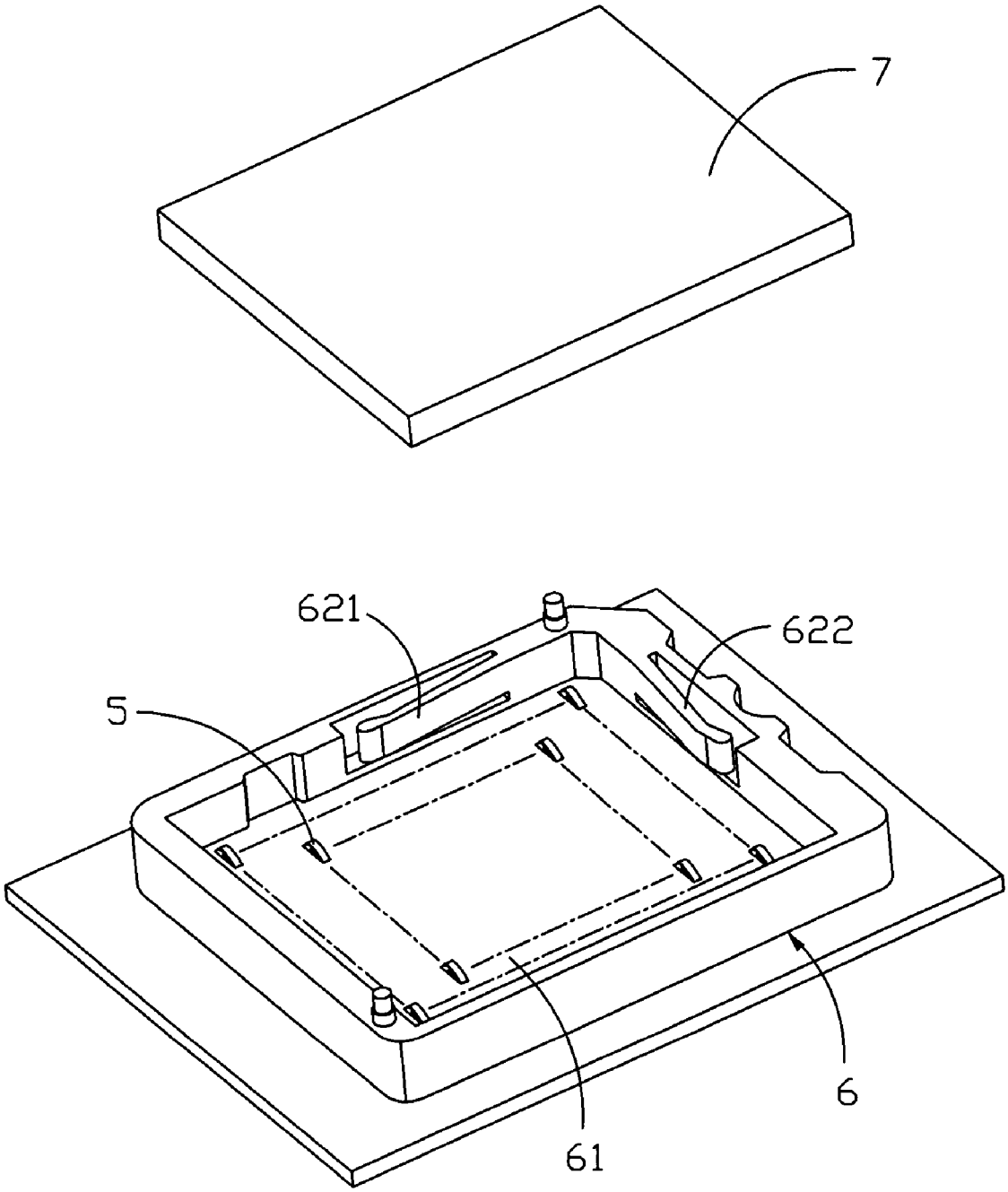
FIG. 1 illustrates a view of an electrical connector of the first embodiment in accordance with the present invention.
Figure 2:
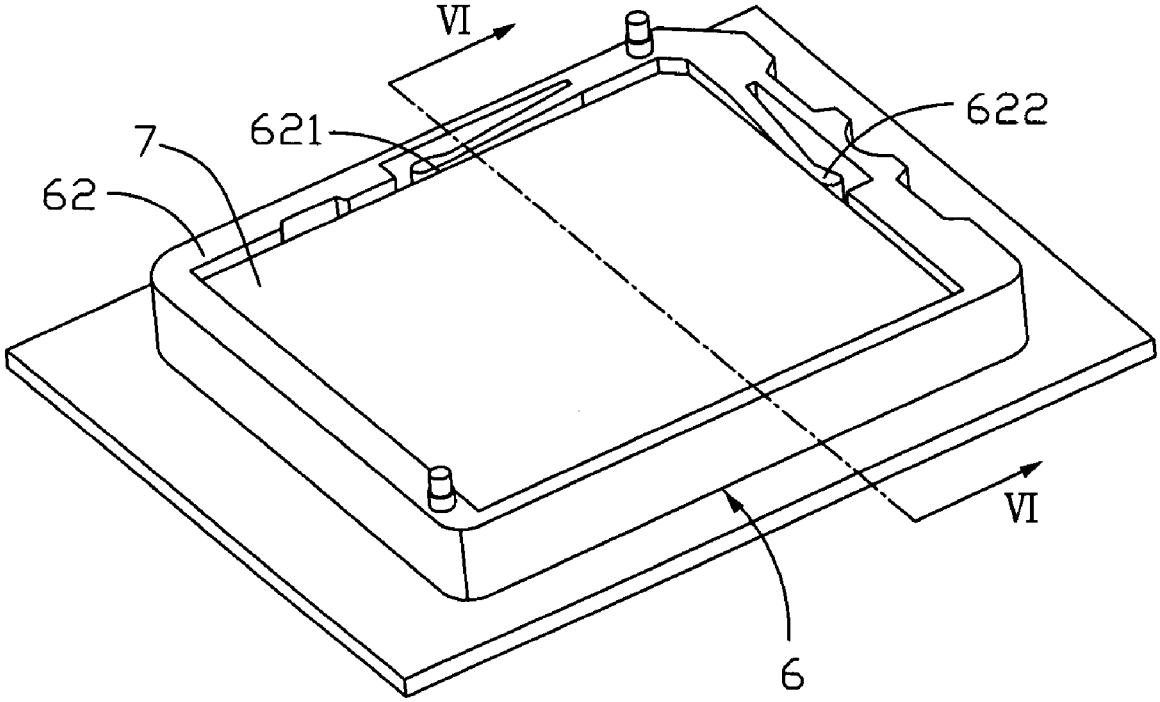
FIG. 2 illustrates a view of an electrical connector mating with a plug assembly of the first embodiment in accordance with the present invention.
Figure 3:
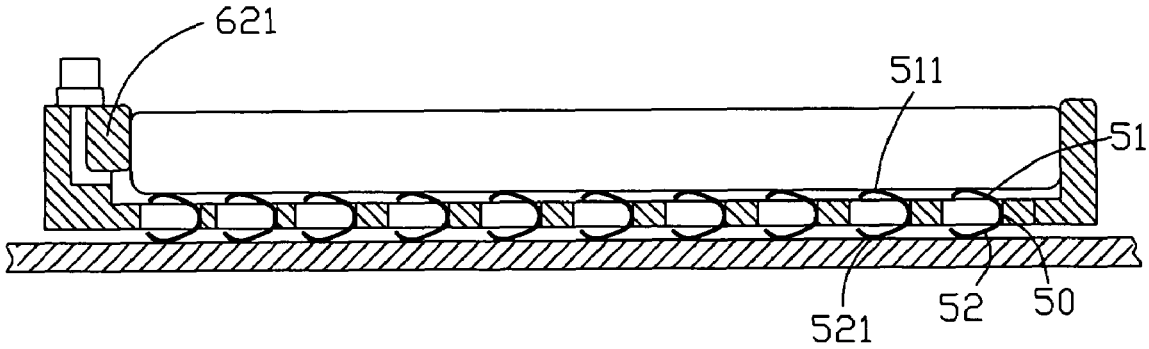
FIG. 3 is an cross-sectional view along the line III-III in the FIG. 2.

Hereinafter, the present invention will be described in detail with reference to the accompanying drawings.

Referring to FIGS. 1-4, the electrical connector in accordance with a first embodiment of the present invention. The electrical connector includes a dielectric housing 6, which comprises a base 61 having four sidewalls 62 extending therefrom. The base 61 defines a plurality of passageways for receiving the spring contacts 5. The base 61 defines a receiving cavity for receiving the plug assembly 7 together with the four sidewalls. The interior side of the sidewall 62 has a first push finger 621 and a second push finger 622.

The spring contact 5 is generally of a "C" shape, including a retaining portions 50, which mates with passageways, so as to fix the spring contact 5 in the passageways. A first and second resilient arm 51, 52 extends symmetrically from the two opposite sides of the retaining portion 50. End of the first resilient arm 51 of the contact 5 forms a first contacting portion 511 to mate with conductive pads (not shown) on the plug assembly 7 and each of the second resilient arm 52 defines a second contacting portion 521 to mate with conductive pads (not shown) on the PCB.

Figure 4:
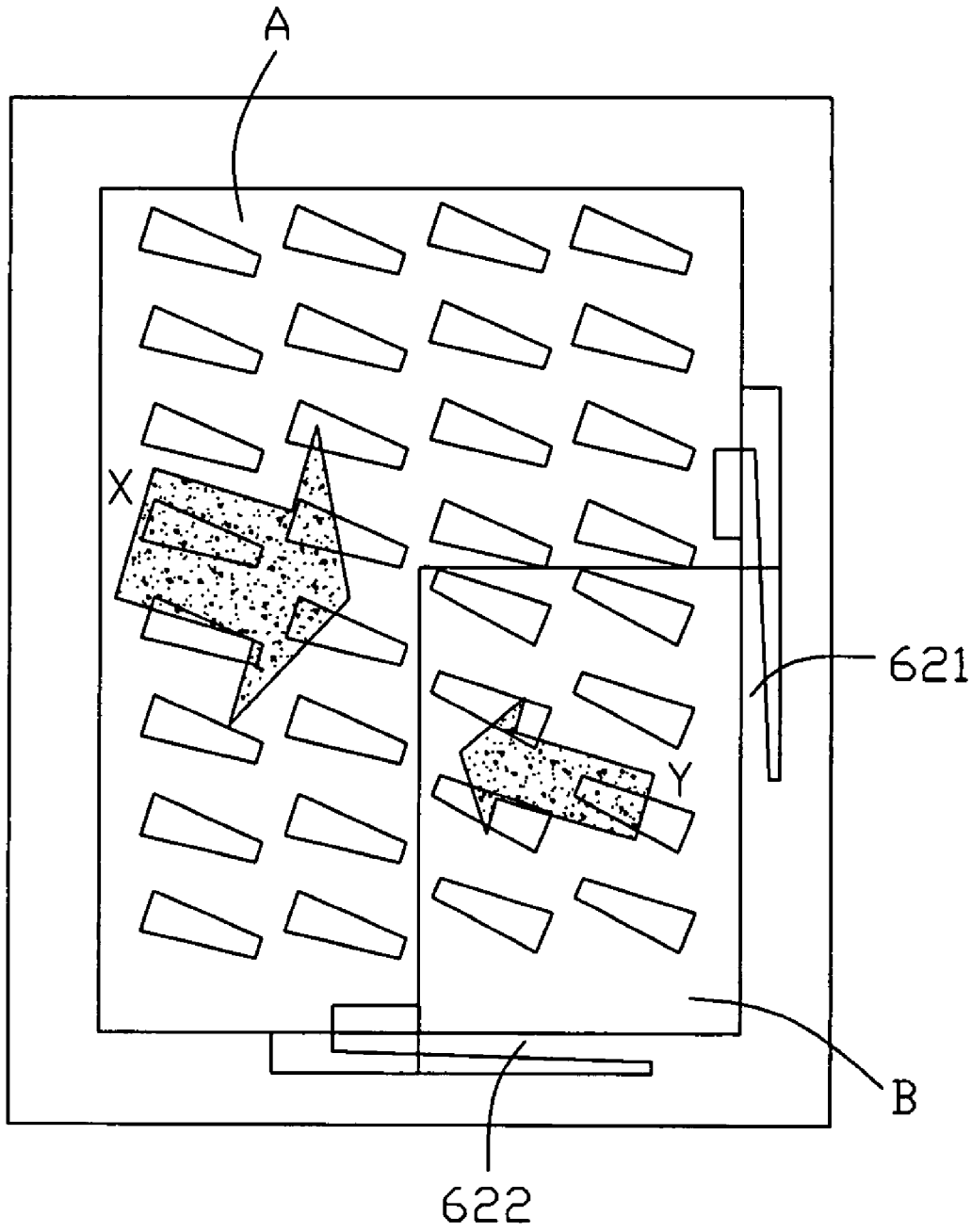
FIG. 4 depicts a sketch of the electrical connector according to the first embodiment, showing how the spring contacts and the push finger arranged.

Referring to FIG. 4, we can see, the base 61 is divided into section A and section B, each of the sections having a plurality of spring contacts 5 therein and section A having more spring contacts 5 than section B. In section A, all the spring contacts 5 are oriented in a first direction, while all the spring contacts 5 of the section B are oriented in another direction opposite to the direction of the spring contacts 5 being oriented in section A. The resilient arms of the spring contacts 5 received in section A extend toward the sidewalls 62 that have the first, second push finger 621, 622. As the plug assembly 7 is mated into the electrical connector, the spring contacts 5 wipe across the conductive pads of the plug assembly 7 and exert a resistive force on the conductive pads of the plug assembly 7. The resistive force typically has normal and tangential components and tangential force is usually caused by the frictional behavior of the wiping motion of the plug assembly 7.

As shown in the FIG. 4, the direction of the resilient arm of the spring contacts 5 received in section A opposes the direction of the spring contacts 5 received in section B. Thus, when the plug assembly 7 is mated into the receiving cavity of the housing 6, the spring contacts received in section A wipe corresponding conductive pads in the direction of arrow X, while the spring contacts 5 received in the section B wipe corresponding conductive pads of the plug assembly 7 in the direction of arrow Y. The spring contacts 5 received in section A exert a tangential component force on the plug assembly 7 in the direction of arrow X, while the spring contacts 5 of section B exert a tangential component force on the assembly 7 in the direction of arrow Y. All the spring contacts are formed of the same material and have the same structure behavior, the normal force exerted by the spring contact 5 is equal. The sum of spring contact 5 of section is greater than that of section B, in order to cancel or reduce resulting tangential component force with the electrical connector formed by the mating of the plug assembly 7 and the electrical connector. The composition of the tangential force is along the direction of arrow X, the push fingers 621, 622 are disposed on sidewalls that oppose the arrow X, in order to cancel the composition forces. Hence, the composition of the tangential forces (denoted by arrow X) exerted by the spring contacts 5 reduce, cancel, or at least substantially minimize. However, the composition of the tangential force does not have to be zero. Rather, the composition of the tangential force may be a value that is small enough to ensure adequate alignment between the connector and the plug assembly 7. The electrical connector maintains adequate contact between spring contacts 5 and conductive pads of the plug assembly 7 and ensures the spring contacts 5 remaining adequately aligned to conductive pads.

Figure 5:
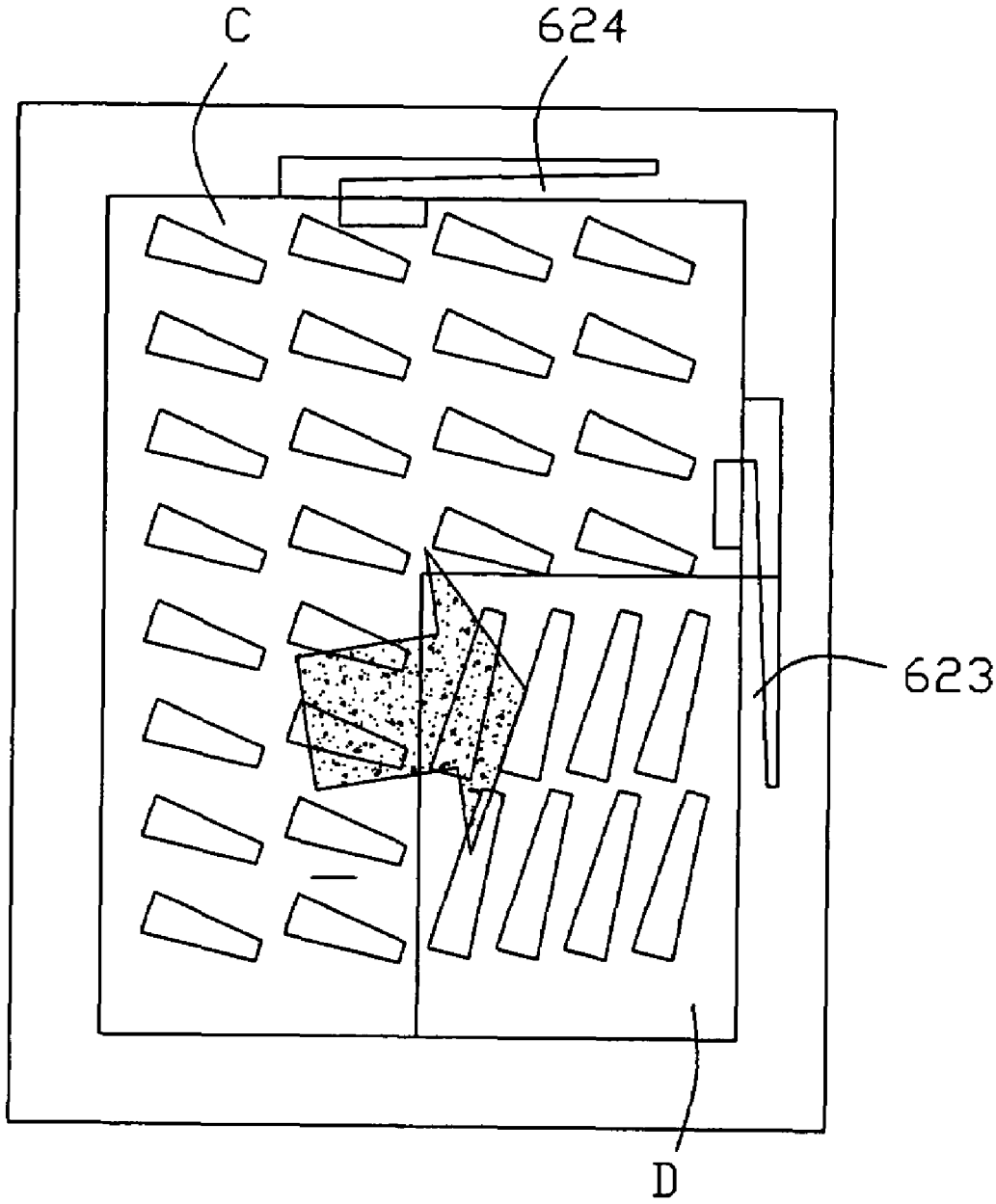
FIG. 5 depicts a sketch of the electrical connector according to the second embodiment, showing how the spring contacts and the push finger arranged.

FIG. 5 illustrates the second embodiment of the present invention. As the first embodiment, the electrical connector includes a dielectric housing 6, which comprises a base 61 having four sidewalls 62 extending therefrom. The base 61 defines a plurality of passageways for receiving the spring contacts 5. The base 61 defines a receiving cavity for receiving the plug assembly 7 together with the four sidewalls 62.

As shown in FIG. 5, the base 61 is divided into section C and D, each of the sections having a plurality of spring contact 5 received therein. The spring contacts 5 received in section C are oriented in a same direction of arrow M, while the spring contacts 5 of section D are oriented in another direction of arrow N, the arrow M and N intercrossing with each other. The spring contacts 5 received in section C wipe the corresponding pads in the direction of arrow M, while the spring contacts 5 of section D wipe corresponding pads in the direction of arrow N. As mentioned above, each spring contact 5 exerts a tangential force on the corresponding conductive pads. All the spring contacts are formed of the same material and have the same structure behavior, the normal force exerted by the spring contact 5 is equal. The tangential force exerted by the spring contacts of section C is along the direction of arrow M, while the tangential force exerted by the spring contacts received in section D is along the direction of arrow N. The sum of the spring contacts 5 received in section C is greater than that of section D. Thus, composition of the tangential force is approximate along a direction of arrow P. As shown in FIG. 5, the composition of the tangential force is along the direction of arrow P, which is out of vertically to the sidewalls 62. Sidewalls, which are opposite to the arrow P, defining a plurality of first and/or second pusher finger 623, 624. When the plug assembly is mated into the receiving cavity of the housing 6, the pusher fingers exert a resilient force in a direction of opposite to the composition of the tangential force along the direction of arrow P, in order to cancer or substantially cancel or reduce resulting tangential forces exerted by the spring contacts. As set forth foregoing, the electrical connector maintains adequate contact between the spring contacts 5 and corresponding pads of the plug assembly 7 and ensures the spring contacts 5 remaining adequately aligned to conductive pads of the plug assembly 7.

Further, in above-mentioned embodiment of the invention, the base 61 is only divided into two sections, and the base 61 also can be divided into more sections. Each of the sections has a plurality of spring contacts 5 received therein, spring contacts 5 received in a same section are oriented in a same direction. Spring contacts 5 received in different section are oriented in a direction that is different from each other. The spring contacts 5 exert a tangential component force on corresponding conductive pads of the plug assembly. The composition of the tangential component force is along a predetermined direction decided by the sum of the spring contacts 5 in each section. Generally, the sections have different sum of the spring contacts 5, so the composition of the tangential component force is opposite to some of the sidewalls 62 of the housing 6. Said sidewalls define a plurality of push fingers, which exert a resilient force of a direction opposite to the direction of the composition of tangential component force, in order to cancel or substantially cancel or reduces the composition of the tangential component force. Thus, the electrical connector maintains adequate contact between the spring contacts 5 and the corresponding pads of the plug assembly and ensures the spring contacts 5 remaining adequately aligned to conductive pads of the plug assembly 7.

What is claimed is:

1. An electrical connector for electrically connecting a plug assembly with a plurality of conductive pads to a PCB comprising:

an insulative housing having sidewalls arrangement defining a rectangular receiving cavity;

a first and second set of spring contacts disposed in the housing each with deflectable spring arms disposed in the receiving cavity;

the housing defining a pair of push fingers on two neighboring sidewalls by said receiving cavity, a first area configured to near a corner defined by the two neighboring sidewalls wherein the first set of spring contacts are receiving in the first area and oriented in a first direction;

both of the sidewalls defining a second area excluding the first area, the second set of spring contacts receiving in the second area and being oriented in a second direction approximately opposing the first direction;

when a plug assembly is mated into the receiving cavity, all said first set of spring contacts resulting in a first compound force extending along a first direction and all said second set of spring contacts resulting in a second compound force extending along a second direction, and the push fingers on the two neighboring sidewalls resulting in a resilient compound force; wherein the sum of the first compound force and the resilient compound force is equal/approximately equal to the second compound force.

2. An electrical connector comprising:

an insulative housing defining receiving cavity;

a plurality of spring contacts disposed in the housing each with deflectable spring arms disposed in the receiving cavity;

all said spring resulting in a compound force extending along a direction during engagement with an electronic package which is received in the receiving cavity;

the housing defining a pair of resilient and deflectable push fingers on two neighboring sidewalls by said receiving cavity, wherein said direction points to a position around an intersectional corner defined by said two neighboring sidewalls; wherein said spring arms are categorized with at least two groups each generating a sub-compound force during engagement with said electronic package which is received in the receiving cavity under a condition said the sub-compound force of one group can not fully counterbalanced with another sub-compound force of the other group but form said compound force of the all spring arms directing to said position around the corner.

* * * * *